US008246271B2

(12) United States Patent
Verhoff

(10) Patent No.: US 8,246,271 B2
(45) Date of Patent: Aug. 21, 2012

(54) APPARATUS FOR COMPACTING ROAD SHOULDERS

(76) Inventor: Keith Verhoff, Mt. Cory, OH (US)

( * ) Notice: Subject to any disclaimer, the term of this patent is extended or adjusted under 35 U.S.C. 154(b) by 257 days.

(21) Appl. No.: 12/770,926

(22) Filed: Apr. 30, 2010

(65) Prior Publication Data

US 2010/0278589 A1 Nov. 4, 2010

Related U.S. Application Data

(60) Provisional application No. 61/174,713, filed on May 1, 2009.

(51) Int. Cl.
*E01C 19/26* (2006.01)

(52) U.S. Cl. ..... 404/117; 404/127; 404/128; 404/133.2

(58) Field of Classification Search ..... 404/117, 404/127, 128, 133.2
See application file for complete search history.

(56) References Cited

U.S. PATENT DOCUMENTS 2,386,025 A * 10/1945 Wills ..... 404/86
3,146,686 A * 9/1964 Grace et al. ..... 404/127
3,930,741 A * 1/1976 Berry ..... 404/133.2
3,989,404 A 11/1976 Burton
4,005,944 A * 2/1977 Harris ..... 404/133.2
4,856,278 A 8/1989 Widmann et al.
4,867,606 A * 9/1989 Wright ..... 405/182
4,966,499 A * 10/1990 St. Louis ..... 405/271
4,986,010 A 1/1991 Cartner
5,304,013 A 4/1994 Parsons
5,507,593 A * 4/1996 Hollon et al. ..... 404/122
5,860,764 A * 1/1999 Roberts ..... 404/93
6,612,774 B1 9/2003 Dulin
6,793,437 B2 9/2004 Kitko et al.
6,966,725 B2 11/2005 Cochran

* cited by examiner

*Primary Examiner* — Gary S Hartmann
(74) *Attorney, Agent, or Firm* — Fraser Clemens Martin & Miller LLC; James D. Miller

(57) ABSTRACT

An apparatus for compacting road shoulders is provided comprising a primary carriage adapted to be mounted to a vehicle, an attachment carriage adjustably mounted to the primary carriage, a compacting attachment adjustably mounted to the attachment carriage, a control system in communication with at least one actuator, and a vibrator disposed on the apparatus. The apparatus for compacting road shoulders able to be positioned within a normal width of a vehicle, vibrationally compact the road shoulder, and adjust according to a grade of the shoulder.

20 Claims, 7 Drawing Sheets

APPARATUS FOR COMPACTING ROAD SHOULDERS

CROSS-REFERENCE TO RELATED APPLICATIONS

This application claims the benefit of U.S. Provisional Patent Application Ser. Nos. 61/174,713 filed May 1, 2009. The entire disclosure of the above application is hereby incorporated herein by reference.

FIELD OF THE INVENTION

The invention relates generally to road construction and maintenance, and, more particularly to a device adapted to compact a road shoulder.

BACKGROUND OF THE INVENTION

Road shoulders may be formed from a granular material such as gravel or stone. The granular material is deposited adjacent an edge of a road. The granular material is generally compacted prior to use to support the weight of a vehicle. Such road shoulders are typically known as soft shoulders. Failure to compact the granular material prior to use of the soft shoulder may result in excess erosion or displacement of the granular material.

An asphalt roller or a tire of a vehicle may be used to compact the granular material forming the soft shoulder. The asphalt roller or the vehicle traverses a width of the soft shoulder, a weight of the asphalt roller or the vehicle compacts the granular material.

To facilitate water removal from the road and transition the road surface to adjacent ground, the soft shoulder typically includes a grade. The grade of the soft shoulder may be particularly steep when the soft shoulder is formed adjacent a ditch or other drop in elevation. The asphalt roller or the vehicle used to compact the soft shoulder may slide off the soft shoulder and roll over as the asphalt roller or the vehicle traverses the width of the soft shoulder. Generally, the asphalt roller cannot adjust to the grade of the soft shoulder without leaving a driving surface of the road. Further, the tire of the vehicle may leave a rut in the soft shoulder. Water collecting in the rut hastens erosion of the soft shoulder.

Specialized equipment is available for the compaction of the soft shoulder. U.S. Pat. No. 6,612,774 to Dulin discloses an apparatus for compacting road shoulders. Dulin discloses the apparatus for compacting road shoulders including a roller having a fixed grade. Dulin further discloses the apparatus for compacting road shoulders extending beyond a normal width of the vehicle to which the apparatus for compacting road shoulders is attached. The apparatus for compacting road shoulders extending beyond a normal width of the vehicle may restrict mobility of the vehicle and may lead to an accidental collision with another vehicle or a stationary object.

U.S. Pat. No. 5,304,013 to Parsons also discloses a road shoulder compacting apparatus extending beyond a normal width of the vehicle the road shoulder compacting apparatus is attached to. Parsons further discloses the road shoulder compacting apparatus including a roller mounted on a fixed arm. The road shoulder compacting apparatus including a fixed arm may limit the accessibility of a vehicle to which the road shoulder compacting apparatus is attached. Further, the road shoulder compacting apparatus may increase a likelihood of a rollover accident when used to compact shoulders having a steep grade, as the vehicle must operate closer to the road shoulder.

It would be desirable to have an apparatus for compacting road shoulders able to be positioned within a normal width of a vehicle when not in use, able to vibrationally compact the road shoulder, and having a compacting attachment that may be adjusted according to a grade of the shoulder.

SUMMARY OF THE INVENTION

Presently provided by the invention, an apparatus for compacting road shoulders that is able to be positioned within a normal width of a vehicle when not in use, able to vibrationally compact the road shoulder, and having a compactor that may be adjusted according to a grade of the shoulder, has surprisingly been discovered.

In a first embodiment, an apparatus for compacting road shoulders comprises a primary carriage adapted to be mounted to a vehicle, an attachment carriage adjustably mounted to the primary carriage, and a compacting attachment adjustably mounted to the attachment carriage.

In another embodiment, the apparatus for compacting road shoulders comprises a primary carriage adapted to be mounted to a vehicle, an attachment carriage adjustably mounted to the primary carriage, a compacting attachment adjustably mounted to the attachment carriage, and a vibrator disposed on the compacting attachment.

In yet another embodiment, the apparatus for compacting road shoulders comprises a primary carriage adapted to be mounted to a vehicle, an attachment carriage including a support frame and an attachment member, the attachment member adjustably mounted to the support frame, the attachment carriage adjustably mounted to the primary carriage, a compacting attachment adjustably mounted to the attachment member, a first actuator coupled to the primary carriage and the attachment carriage to urge the attachment carriage along a first guide coupled to the primary carriage, a second actuator coupled to the support frame and the attachment member to urge the attachment member along a second guide coupled to the support frame, a vibrator disposed on the compacting attachment, and a control system in communication with the first actuator, the second actuator, and the vibrator.

BRIEF DESCRIPTION OF THE DRAWINGS

The above, as well as other advantages of the present invention, will become readily apparent to those skilled in the art from the following detailed description of the invention when considered in the light of the accompanying drawings in which.

DETAILED DESCRIPTION OF THE INVENTION

The following detailed description and appended drawings describe and illustrate various exemplary embodiments of the invention. The description and drawings serve to enable one skilled in the art to make and use the invention, and are not intended to limit the scope of the invention in any manner.

Figure 1:
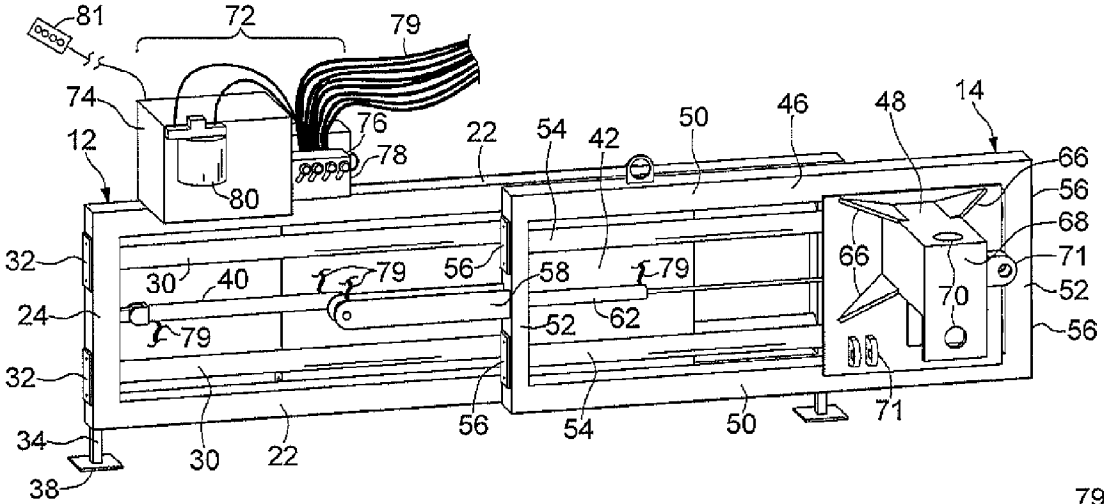
FIG. 1 is a rear perspective view of a primary carriage and an attachment carriage of the apparatus for compacting road shoulders according to an embodiment of the invention.
Figure 2:
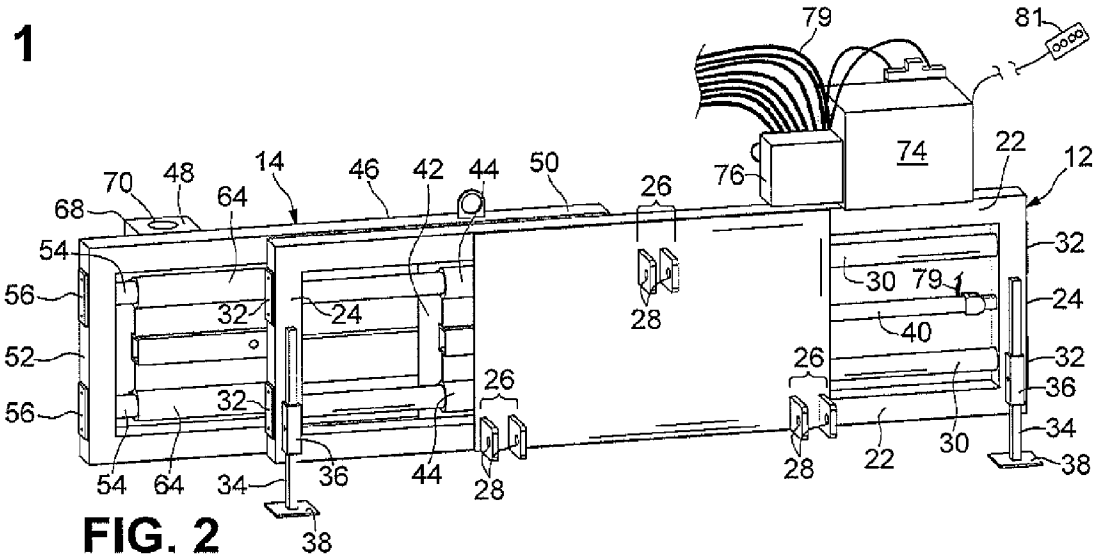
FIG. 2 is a front perspective view of the primary carriage and the attachment carriage illustrated in FIG. 1.
Figure 3:
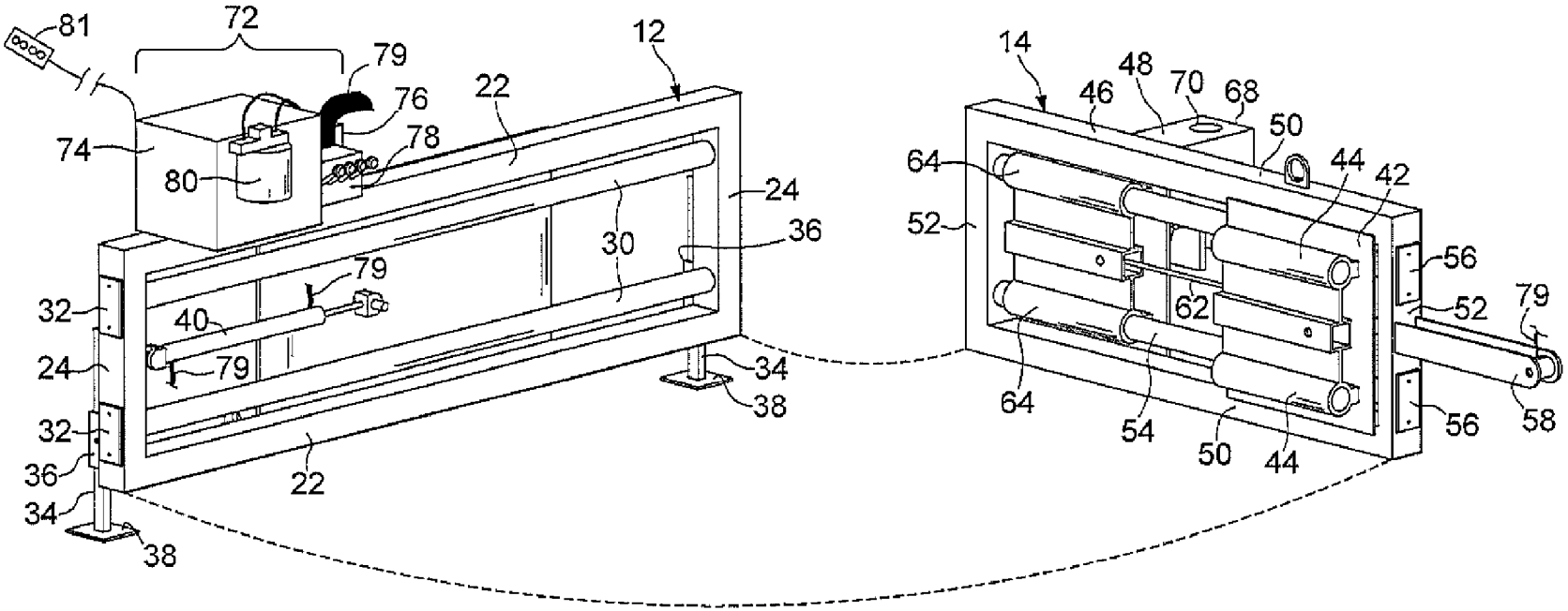
FIG. 3 is a partially exploded perspective view of the primary carriage illustrated and the attachment carriage illustrated in FIG. 1, the attachment carriage spaced apart from the primary carriage for illustrative purposes.

FIGS. 1-3 show a portion of an apparatus 10 for compacting road shoulders according to an embodiment of the present invention. The apparatus 10 includes a primary carriage 12, an attachment carriage 14, and a compacting attachment 16, 18 as illustrated in FIGS. 4-9. As illustrated, the apparatus 10 is releasably connected to a vehicle 20. Although the vehicle 20 shown is a tractor, it is understood that other vehicles can be used as desired.

The primary carriage 12 is a substantially rectangular shaped structure formed from steel. Alternately, the primary carriage 12 may be any shape and formed from any conventional material. The primary carriage 12 includes at least one transverse support 22 and at least one vertical support 24. In the embodiment shown, the at least one transverse support 22 and at least one vertical support 24 are formed from tubular steel and are coupled by welding. At least one mounting point 26 is disposed on a plate coupled to the primary carriage 12. Alternately, the mounting point 26 may be directly affixed to at least one of the transverse support 22 and the vertical support 24. The mounting point 26 includes two spaced-apart members, each having a mounting point aperture 28 formed therein. The mounting point apertures 28 of each spaced apart member are substantially aligned to receive a fastener such as a pin or a bolt, for example. The primary carriage 12 shown includes three mounting points 26 adapted to be coupled to a "three-point" hitch. Alternately, any number of mounting points 26 or other mounting point type may be used. A primary carriage guide 30 is coupled to the vertical supports 24 of the primary carriage 12, substantially parallel to the transverse supports 22. The primary carriage guide 30 is a cylindrical member coupled to the vertical supports 24, but any shape or feature may be used. Alternately, the primary carriage guide 30 may be coupled to the transverse supports 22 or other vertical supports. The primary carriage guides 30 are received within a pair of apertures formed in the vertical supports 24 and guide caps 32 coupled to the vertical supports 24. However, other fastening means may be used.

A support jack 34 is slidingly disposed in a support bracket 36. The support bracket 36 is coupled to the vertical supports 24. The support jack 34 is an elongate member having a support foot 38 depending from an end thereof. A linear array of support apertures is formed in the support jack 34, each of which is adapted to receive a fastener therein such as a pin, for example, to facilitate a height adjustment of the support jack 34. The support jack 34 facilitates attachment, detachment, and storage of the apparatus 10.

A first actuator 40 has a first end coupled to the primary carriage 12 and is substantially parallel to the transverse support 22. The first actuator 40 is a hydraulic cylinder, but other actuator types such as an electrical or pneumatic actuator may be used. A second end of the first actuator 40 is coupled to a slide plate 42. The slide plate 42 is disposed adjacent the primary carriage 12. At least one slide plate collar 44 is coupled to the slide plate 42. The slide plate collar 44 is slidingly disposed on the primary carriage guide 30.

The attachment carriage 14 includes a support frame 46 and an attachment member 48. The support frame 46 may be any shape and formed from any conventional material. The support frame 46 includes at least one transverse support 50 and at least one vertical support 52. As shown, the at least one transverse support 50 and at least one vertical support 52 are formed from tubular steel and are coupled by welding.

An attachment carriage guide 54 is coupled to the vertical supports 52 of the support frame 46, substantially parallel to the transverse supports 50. The attachment carriage guide 54 is a cylindrical member coupled to the vertical supports 52, but any shape or feature may be used. Alternately, the attachment carriage guide 54 may be coupled to the transverse supports 50 or other vertical supports. The attachment carriage guide 54 is received within a pair of apertures formed in the vertical supports 52 and guide caps 56 coupled to the vertical supports 52, but other fastening means may be used.

An actuator mount 58 includes a pair of spaced apart rigid members laterally extending from one of the vertical supports 52 and is coupled to the vertical support 52 by welding. The actuator mount 58 may comprise other shapes and may be coupled to the support frame 46 using other means. An actuator aperture is formed through the vertical support 52, adjacent the spaced apart members of the actuator mount 58.

A second actuator 62 is disposed in the actuator aperture and has a first end coupled to a distal end of the actuator mount 58 and a second end coupled to the attachment member 48. The second actuator 62 is substantially parallel to the transverse support 50. The second actuator 62 is a hydraulic cylinder, but any other actuator types such as an electrical or pneumatic actuator may be used.

As shown, the attachment member 48 is substantially "L" shaped and formed from square tubing and plate metal, but other shapes and materials may be used. At least one attachment member collar 64 is coupled to the attachment member 48 such as by welding, for example. The attachment member collar 64 is slidingly disposed on the attachment carriage guide 54. At least one member gusset 66 is formed on the attachment member 48. An attachment mount 68 is formed on the attachment member. The attachment mount 68 includes at least one attachment point 70. As shown, the attachment mount 68 includes the attachment point 70 vertically oriented and the attachment point 70 horizontally oriented. As shown, the attachment points 70 are circular apertures formed through the attachment member 48, and may be formed through spaced apart members, but any shape and configuration may be used. At least one actuator mount 71 comprising spaced apart members having apertures formed therethrough is disposed on the attachment member 48. As shown, the attachment member includes two actuator mounts 71 welded thereto.

A hydraulic control system 72 is disposed on the primary carriage 12. Alternately, the hydraulic control system 72 may be disposed on the vehicle 20 or portions of the hydraulic control system 72 may be disposed on at least one of the apparatus 10 and the vehicle 20. The hydraulic control system 72 is in communication with the first actuator 40, the second actuator 62 and at least one actuator coupled to the compacting attachment 16, 18 to facilitate operation of the apparatus 10. As shown, the hydraulic control system 72 communicates with the actuators 40, 62 and the at least one actuator coupled to the compacting attachment 16, 18 using a pressurized fluid. Alternately an electrical, a pneumatic, or a mechanical means may be used to facilitate operation of the actuators 40, 62, and the compacting attachment 16, 18.

The hydraulic control system 72 includes a reservoir 74, a pump 76, a control valve 78, a plurality of communication lines 79, and a remote controller 81. Hydraulic control systems are known in the art, such as disclosed in U.S. Pat. No. 4,856,278 to Widmann et al., incorporated herein by reference in its entirety. The reservoir 74 is a container coupled to the primary carriage 12 in fluid communication with the pump 76 and the control valve 78. As shown, a fluid filter 80 may be disposed in a communication line 79 between the control valve 78 and the reservoir 74. The pump 76 is typically a positive displacement pump disposed on the primary carriage 12 in fluid communication with the reservoir 74 and the control valve 78. Alternately, the pump 76 may be disposed on the vehicle 20. It is noted a hydraulic system forming a portion of the vehicle 20 may be in communication with the actuators 40, 62 instead of the hydraulic control system 72. The pump 76 may be a mechanically operated pump driven by a power take off of the vehicle 20. Alternately, the pump 76 may be driven by an engine separate the vehicle 20 or the pump 76 may be an electrically operated pump. The control valve 78 is disposed on the primary carriage 12 and includes a plurality of valves and manifolds in fluid communication with the pump 76, the reservoir 74, the actuators 40, 62 and the compacting attachments 16, 18 via the communication lines 79. Alternately, the control valve 78 may be disposed on any portion of the vehicle 20. The control valve 78 permits a user of the apparatus 10 to selectively direct a flow of pressurized fluid to the actuators 40, 62, and the compacting attachments 16, 18. The control valve 78 may be operated using a plurality of levers, electronic actuators, or a combination thereof.

The remote controller 81 is a portion of the hydraulic control system 72 in communication therewith. The remote controller 81 permits the user to operate the actuators 40, 62 and the compacting attachments 16, 18 from an operating position of the vehicle 20. Typically, the remote controller 81 comprises a plurality of electrical components such as switches, actuators, and relays, but pneumatic or mechanical controls may also be used. The remote controller 81 may be removably coupled to the vehicle. As a non-limiting example, the remote controller 81 may be magnetically coupled to component of the vehicle 20 or removably coupled to a mounting bracket disposed on the vehicle 20.

Figure 4:
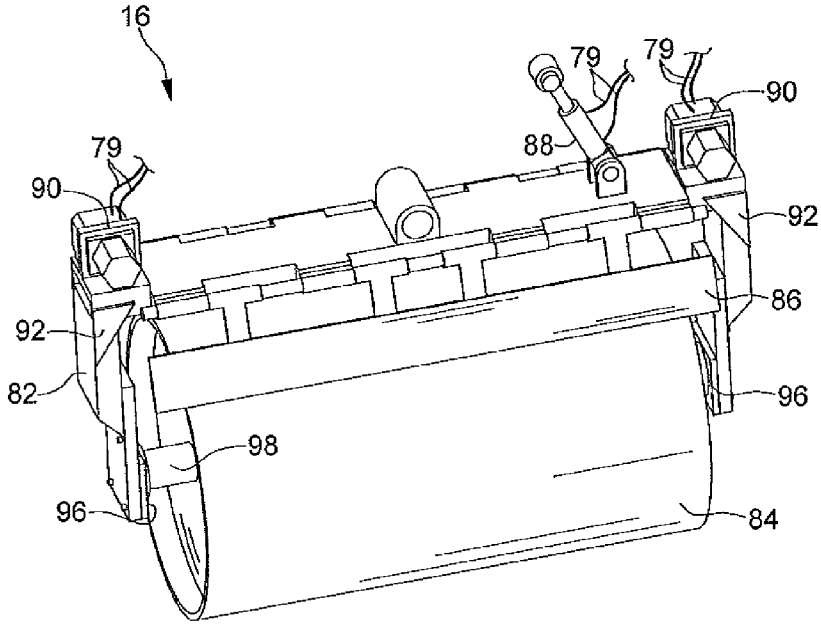
FIG. 4 is a perspective view of a compacting attachment of the apparatus for compacting road shoulders according to an embodiment of the invention.
Figure 5:
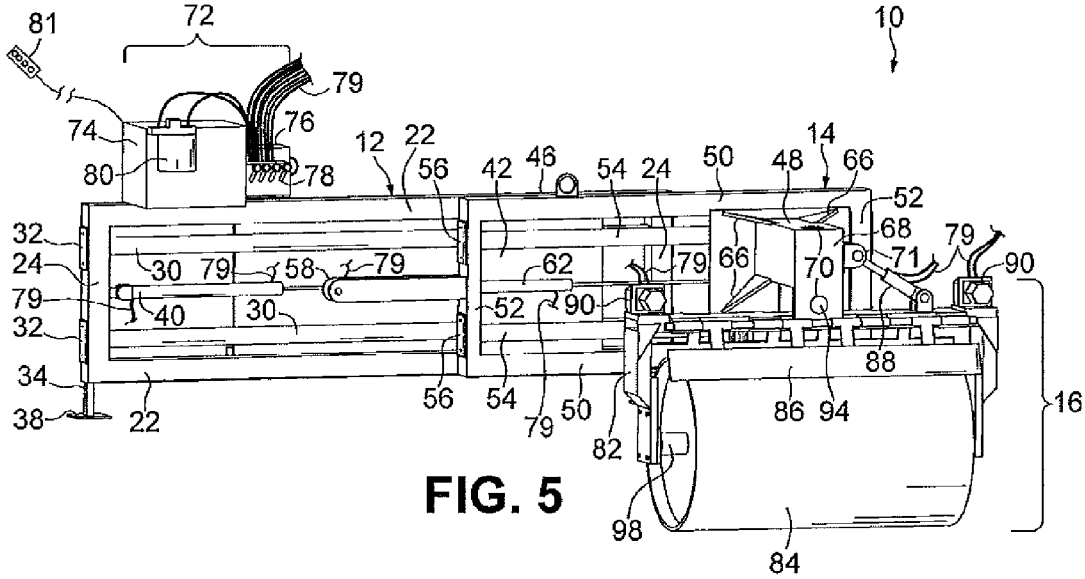
FIG. 5 is a perspective view of the apparatus for compacting road shoulders including the primary carriage and the attachment carriage illustrated in FIGS. 1 and 2 and the compacting attachment illustrated in FIG. 4.
Figure 6:
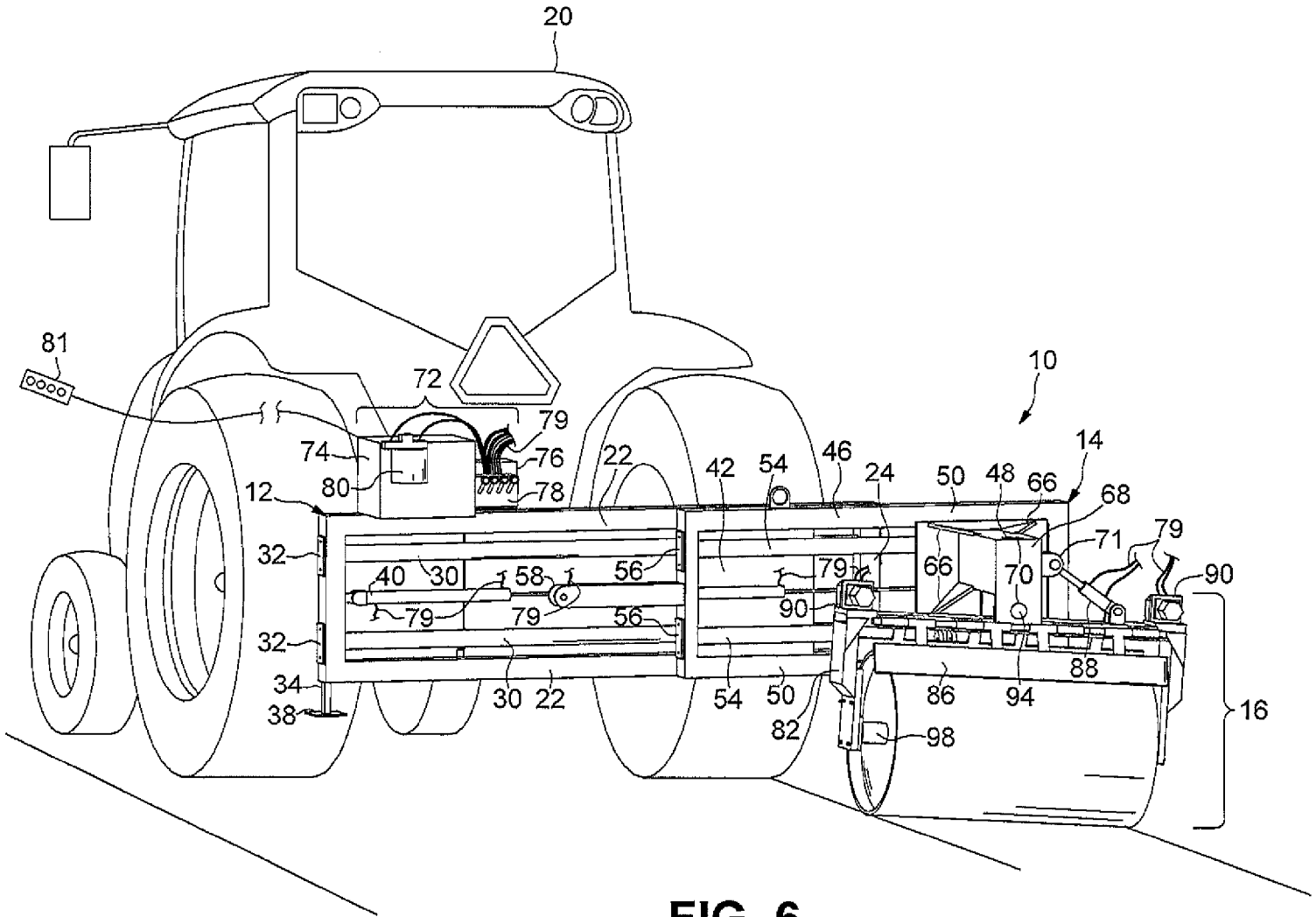
FIG. 6 is a perspective view of the apparatus for compacting road shoulders illustrated in FIG. 5, the apparatus coupled to a vehicle and the compacting attachment in a pivoted position.

FIG. 4 illustrates the compacting attachment 16. The compacting attachment 16 is a roller. The roller includes a roller mount 82, a roller drum 84, a drum scraper 86, a roller actuator 88, and a roller vibrator 90. FIGS. 5 and 6 illustrate the compacting attachment 16 coupled to the primary carriage 12 and the attachment carriage 14 to form the apparatus 10.

The roller mount 82 is a substantially "C" shaped structure formed from a plurality of tube sections and plate metal. The tube sections have a rectangular cross-section and are coupled by a plurality of welds. Alternately, a plurality of fasteners may be used to couple the tube sections forming the roller mount 82. A plurality of roller mount gussets 92 may be used to reinforce the roller mount 82. Alternately, the roller mount 82 may be any shape and formed from any conventional material. The roller mount 82 is pivotally coupled to the attachment member 48 at the attachment point 70 horizontally oriented by a pivot pin 94. An axle mount 96 is disposed on the roller mount 82. As shown, the roller mount 82 includes two opposed axle mounts 96 disposed thereon. The axle mount 96 is coupled to the roller mount 82 by a plurality of fasteners. Other fasteners such as a plurality of welds, may also be used to couple the axle mount 96 to the roller mount 82.

The roller drum 84 is rotatingly coupled to the axle mount 96. The roller drum 84 is a hollow steel drum having a rolling surface that is substantially smooth. However, other roller types may be used. The roller drum 84 may be filled with water, sand, or other material to increase a mass of the roller drum 84. Alternately, a thickness of a portion of the roller drum 84 may be increased to provide increased mass. A roller axle 98 disposed through the roller drum 84 or coupled to at least one end of the roller drum 84 is disposed in an axle bearing. The roller axle 98 and the axle bearing are disposed in the axle mount 96, permitting the roller axle 98 and the roller drum 84 to rotate therein.

The drum scraper 86 is hingedly coupled to the roller mount 82. As shown, the compacting attachment 16 includes two drum scrapers 86, but any number may be used. A plurality of cylindrical scraper mounts disposed on the roller mount 82 and a scraper pivot pin cooperate with pivot points to hingedly couple the drum scraper 86 to the roller mount 82. The drum scraper 86 contacts the roller drum 84 across a width of the roller drum 84 to remove granular material or other matter adhering thereto. Alternately, any other hinged or pre-tensioned member coupled to the roller mount 82 may form the drum scraper 86.

The roller actuator 88 is coupled at a first end thereof to the actuator mount 71 of the attachment member 48. A second end of the roller actuator 88 is coupled to the roller mount 64. The roller actuator 88 is positioned obliquely to the roller mount 82. As shown, the roller actuator 88 is a hydraulic cylinder in fluid communication with the hydraulic control system 72, but other actuators such as an electrical or pneumatic actuator may be used.

The roller vibrator 90 is disposed on the roller mount 82. The roller vibrator 90 is in fluid communication with the hydraulic control system 72 and includes a hydraulic motor, for example, in communication with a shaft having offset weights disposed thereon. The shaft is mounted to bearings and is caused to rotate by the motor. Due to the offset of the weights on the shaft, a vibration of the compacting roller mount 82 is caused during the rotation thereof which results in a vibration of the roller drum 84. As shown, two roller vibrators 90 are disposed on opposing ends of the roller mount 82. It is understood that other vibration mechanisms may be disposed on the attachment carriage 14 or the primary carriage 12. Vibration insulators such as rubber insulators may be provided between the compacting attachment 16 and the attachment member 48 to militate against a transfer of the vibration from the compacting attachment 16 to the carriages 12, 14 and the vehicle 20.

FIG. 6 illustrates the apparatus 10 configured with the compacting attachment 16 in use. In anticipation of compacting road shoulders, the user of the apparatus 10 attaches the apparatus 10 to the vehicle 20. The user then raises the apparatus 10 at the mounting points 26 using the "three-point" hitch or other raising device affixed to the vehicle. The support jacks 34 are then moved from an extended position (not shown) to a retracted position. In anticipation of traveling to a worksite, the user positions the apparatus 10 in a travel position. In the travel position, the apparatus 10 does not contact the ground and the attachment carriage 14 and compacting attachment 16 are positioned substantially within a side-to-side profile of the vehicle 20.

Upon reaching the worksite, the user positions the vehicle 20 adjacent a road shoulder in need of compacting. The user then employs the control valve 78 or the remote controller 81 to extend the first actuator 40 and the second actuator 62. The first actuator 40 urges the attachment carriage 14 along the primary carriage guide 30 with respect to the primary carriage 12. The second actuator 62 urges the attachment member 48 along the attachment carriage guide 54 with respect to the attachment carriage guide 14. The first actuator 40 and the second actuator 62 may be controlled independently or may operated simultaneously to extend the attachment carriage 14 and the attachment member 48 towards the road shoulder. When the compacting attachment 16 is positioned over the road shoulder, the apparatus 10 is moved into an operating position. In the operating position, the apparatus 10 is lowered until the roller drum 84 of the compacting attachment 16 contacts the road shoulder.

Before, during, or after the lowering of the apparatus 10 the user may direct the control valve 78 or the remote controller 81 to extend the roller actuator 88 to pivot the roller mount 82 and roller drum 84 about the attachment point 70. The user extends the roller actuator 88 until the roller axle 98 is substantially parallel to a desired angle or grade of the road shoulder. By adjusting the height of the "three-point" hitch, and thus the height of the apparatus 10, the user may adjust a force exerted by the compacting attachment 16 to compact the road shoulder. The user may engage the roller vibrator 90 using the control valve 78 or the remote controller 81. The user then operates the vehicle 20, maintaining the position of the compacting attachment 16 with respect to the road shoulder. The force exerted by the compacting attachment 18, in addition to vibration provided by the roller vibrator 90, compacts the road shoulder in need of compacting.

After the compacting attachment 16 has traversed the portion of the road shoulder needing compaction, the user may stop the vehicle 20, disengage the roller vibrator 90, and raise the apparatus 10 from the road shoulder. The user may then move the vehicle 20 to another portion of the road having a road shoulder requiring compaction. Alternately, the user may direct the control valve 78 or the remote controller 81 to retract the roller actuator 88 until the roller axle 98 is substantially parallel to the road. The user may then retract the actuators 40, 62 to return the apparatus 10 to the travel position.

Figure 7:
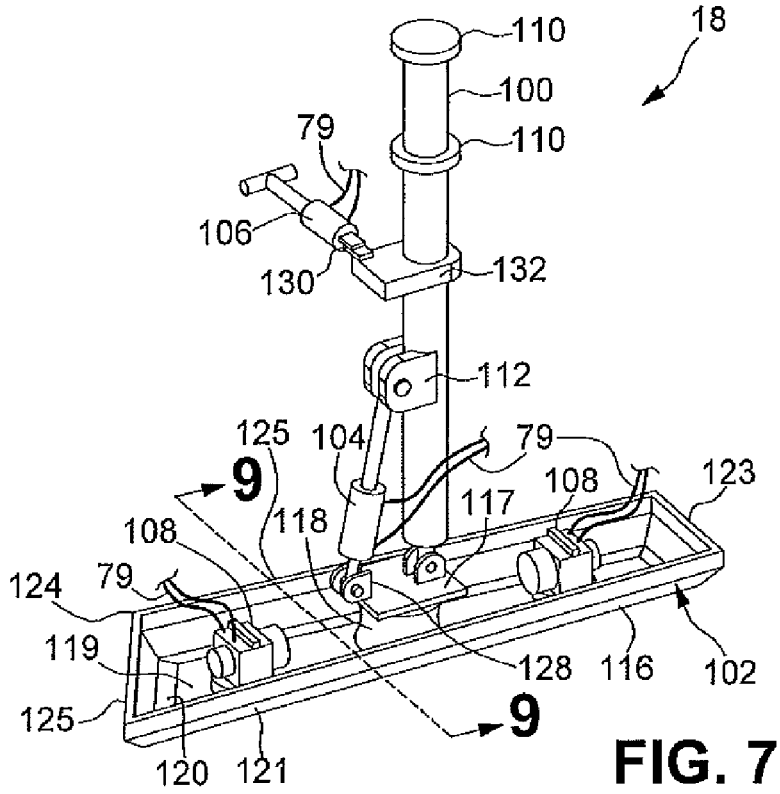
FIG. 7 is a perspective view of a compacting attachment of the apparatus for compacting road shoulders according to another embodiment of the invention.
Figure 8:
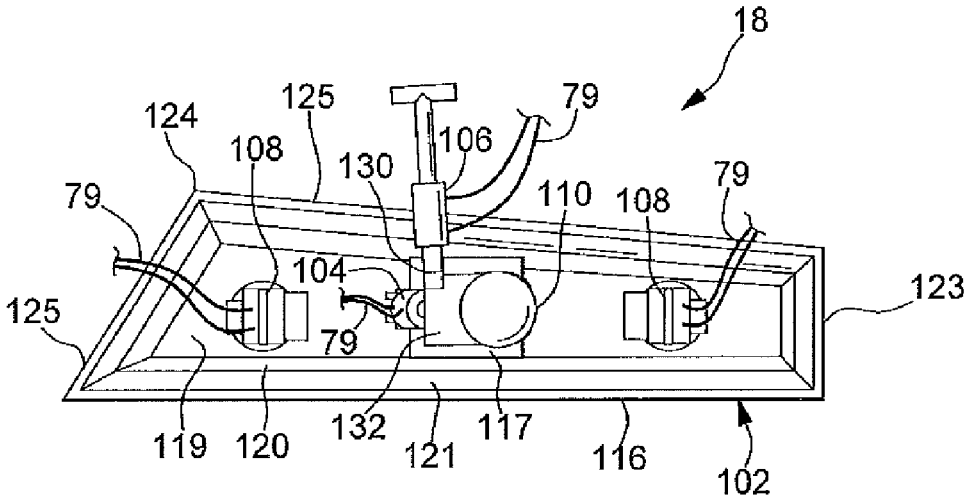
FIG. 8 is a top plan view of the compacting attachment of the apparatus for compacting road shoulders illustrated in FIG. 7.
Figure 9:
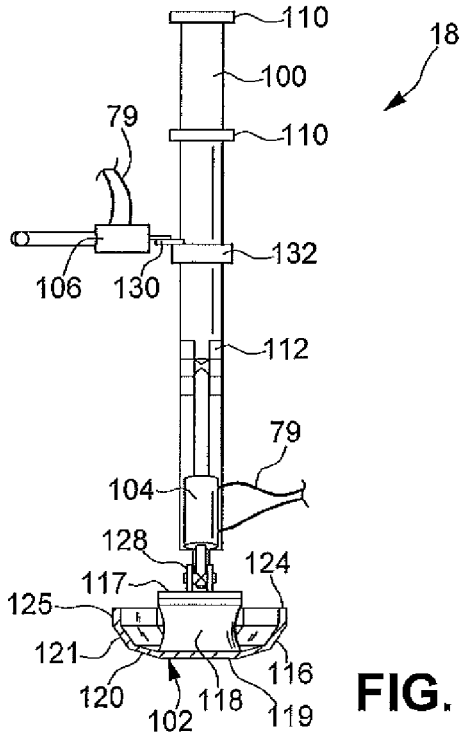
FIG. 9 is a cross-sectional, side elevational view of the compacting attachment shown in FIGS. 7 and 8, taken along section line 9-9 in FIG. 7.
Figure 10:
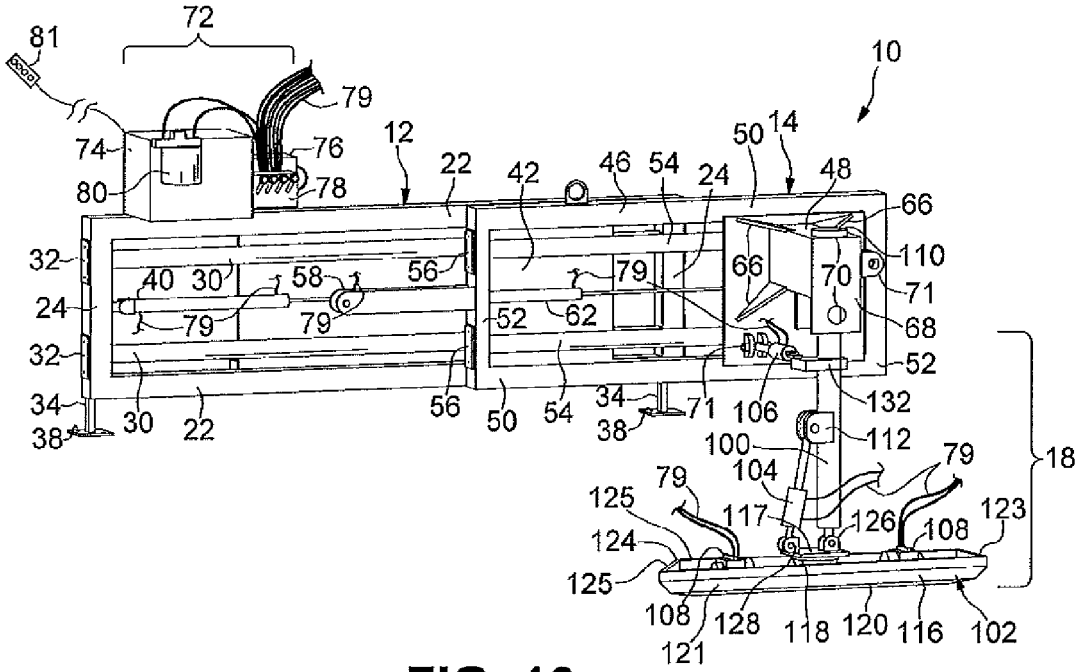
FIG. 10 is a perspective view of the apparatus for compacting road shoulders including the primary carriage and the attachment carriage illustrated in FIGS. 1-3 and the compacting attachment illustrated in FIGS. 7-9.
Figure 11:
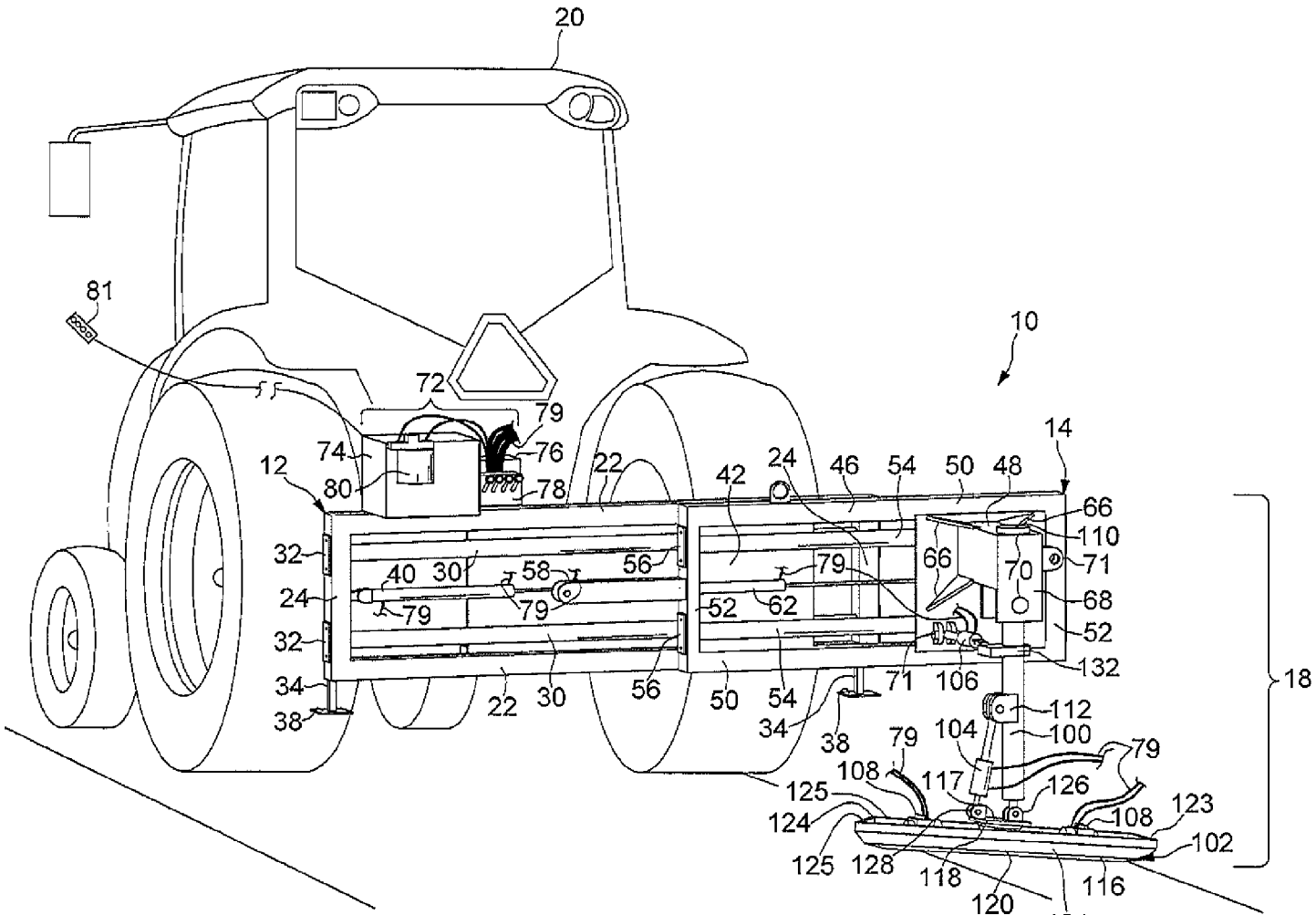
FIG. 11 is a perspective view of the apparatus for compacting road shoulders illustrated in FIGS. 7-9, the apparatus coupled to a vehicle and the compacting attachment in a rotated and pivoted position.

FIGS. 7-9 illustrate the compacting attachment 18. The compacting attachment 18 is a tamp. The compacting attachment 18 includes a mounting member 100, a plate 102, a tamp pivot actuator 104, a rotational actuator 106, and a tamp vibrator 108. FIGS. 10 and 11 show another embodiment of the invention similar to that shown in FIGS. 5 and 6. FIG. 10 illustrates the compacting attachment 18 coupled to the primary carriage 12 and the attachment carriage 14 to form the apparatus 10.

The mounting member 100 is a substantially cylindrical shaped structure formed from tubular metal. Alternately, the mounting member 100 may be any shape and formed from any conventional material. The mounting member 100 has at least one retention collar 110 disposed thereon at a first end. The mounting member 100 is rotatingiy coupled to the attachment member 48 by the at least one retention collar 110 at the attachment point 70 vertically oriented. The retention collar 110 is removably coupled to the mounting member 100 to facilitate installation and removal of the compacting attachment 18 to the attachment member 48. A first pivot actuator mount 112 with spaced apart members having apertures formed therethrough is welded to the mounting member 100 at an intermediate position. A pivot point is formed in a second end of the mounting member 100. A pivot pin disposed through the pivot point pivotably couples the mounting member 100 to the plate 102.

The plate 102 includes a main body 116, a mount plate 117, and a vibration isolator 118. The plate 102 is formed from a steel or other rigid material and may be of a unitary or composite construction. A stamping process or welding process may be used to form the plate 102 from a blank or a plurality of components. The plate 102 includes angled walls extending from a central base portion 119 to an upper peripheral edge 123 of the plate 102. As shown, the angled walls include a first angled wall 120 and a second angled wall 121, the first and second angled walls 120, 121 formed obliquely to the central base portion 119. As shown the first angled wall 120 is formed at about 15 degrees from the central base portion, but other angles less than 45 degrees may be used. As shown the second angled wall 121 is formed at about 60 degrees from the central base portion, but other angles between 45 degrees and 90 degrees may be used. Alternately, the transitionary portion may be an arcuate shape or a plurality of arcuate shapes. Further, as shown in FIG. 8, two of the angled walls meet at an obtuse angle to form a compaction vertex 124. The compaction vertex 124 and the angled walls form a leading edge 125 of the plate 102. The vibration isolator 118 is removably coupled to the central base portion 119. The vibration isolator 118 is formed from a resilient material such as rubber and includes at least one of a threaded stud or threaded insert formed therein for coupling the vibration isolator to the plate 102 and the mount plate 117. The mount plate 117 is a substantially rectangular piece of steel plate coupled to the vibration isolator 118. Other shapes and materials may also be used to form the mount plate 117. The mount plate 117 includes a member mount 126 and a second pivot actuator mount 128 disposed thereon. The mounts 126, 128 include spaced apart members having apertures formed therethrough welded to the mount plate 117. Other coupling means may also be disposed on the mount plate 117 to couple the mounting member 100 and the tamp pivot actuator 104 thereto.

The tamp pivot actuator 104 is coupled at a first end thereof to the first pivot actuator mount 112. A second end of the tamp pivot actuator 104 is coupled to the second pivot actuator mount 128. The tamp pivot actuator 104 is positioned obliquely to the mounting member 100. The tamp pivot actuator 104 is a hydraulic cylinder in fluid communication with the hydraulic control system 72, but other actuators such as an electrical or pneumatic driven actuator may be used.

The rotational actuator 106 is coupled at a first end thereof to the actuator mount 71. A second end of the rotational actuator 106 is coupled to a mount 130 formed on a mounting member cam 132. The mounting member cam 132 is a member coupled at an intermediate position to the mounting member 100. The mounting member cam 132 may be welded to the mounting member 100 or coupled thereto using fasteners, for example. The mount 130 includes spaced apart members having apertures formed therethrough and is welded to the mounting member cam 132. The rotational actuator 106 is positioned substantially perpendicularly to the mounting member 100. The rotational actuator 106 is a hydraulic cylinder in fluid communication with the hydraulic control system 72, but other actuators such as an electrical or pneumatic driven actuator may be used.

The tamp vibrator 108 is disposed on the main body 116, as illustrated in FIGS. 7, 8, 10, and 11. The tamp vibrator 108 is in fluid communication with the hydraulic control system 72 and includes a hydraulic motor, for example, in communication with a shaft having offset weights disposed thereon. The shaft is mounted to bearings and is caused to rotate by the motor. Due to the offset of the weights on the shaft, a vibration of the main body 116 is caused. As shown, two tamp vibrators 108 are disposed on the main body 116. It is understood that other vibration mechanisms can be used.

FIG. 11 illustrates the apparatus 10 configured with the compacting attachment 18 in use. In anticipation of compacting road shoulders, the user of the apparatus 10 attaches the apparatus 10 to the vehicle 20. The user then raises the apparatus 10 at the mounting points 26 using the "three-point" hitch or other raising device affixed to the vehicle. The support jacks 34 are then moved from an extended position (not shown) to a retracted position. In anticipation of traveling to a worksite, the user positions the apparatus 10 in a travel position. In the travel position, the apparatus 10 does not contact the ground and the attachment carriage 14 and compacting attachment 18 are positioned substantially within a side-to-side profile of the vehicle 20.

Upon reaching the worksite, the user positions the vehicle 20 adjacent a road shoulder in need of compacting. The user then uses the control valve 78 or the remote controller 81 to extend the first actuator 40 and the second actuator 62. The first actuator 40 urges the attachment carriage 14 along the primary carriage guide 30 with respect to the primary carriage 12. The second actuator 62 urges the attachment member 48 along the attachment carriage guide 54 with respect to the attachment carriage guide 14. The first actuator 40 and the second actuator 62 may be controlled independently or may operated simultaneously to extend the attachment carriage 14 and the attachment member 48 towards the road shoulder. When the compacting attachment 18 is positioned over the road shoulder, the apparatus 10 is moved into a tamping position. In the tamping position, the apparatus 10 is lowered until the plate 102 of the compacting attachment 18 contacts the road shoulder.

Before, during, or after the lowering of the apparatus 10 the user may direct the control valve 78 or the remote controller 81 to extend the tamp pivot actuator 104 to pivot the compacting attachment 18 about an axis of the member mount 126. The user extends the tamp pivot actuator 104 until the plate 102 is substantially parallel to a desired angle or grade of the road shoulder. The user may also extend the rotational actuator 106, causing the compacting attachment 18 to rotate about the mounting member 100, until the plate 102 is desirably positioned with respect to the road shoulder in need of compacting. By adjusting the height of the "three-point" hitch, and thus the height of the apparatus 10, the user may adjust a force exerted by the compacting attachment 18 to compact the road shoulder. The user may engage the tamp vibrator 108 using the control valve 78 or the remote controller 81. The user then operates the vehicle 20, maintaining the position of the compacting attachment 18 with respect to the road shoulder. During compaction of the road shoulder, the first portion of the plate 102 to contact the road shoulder in need of compacting is the leading edge 125 of the plate 102. The leading edge 125 directs the granular material under the plate 102. The first and second angled walls 120, 121 facilitate a progressive compaction of the granular material. The second angled wall 121 directs a partial amount of the force exerted by the compacting attachment into the granular material, compacting the granular material to a primary degree. Upon compaction by the second angled wall 121, the granular material is compacted by the first angled wall 120. The first angled wall 120 directs an amount of the force exerted by the compacting attachment greater than the partial amount into the granular material, compacting the granular material to a secondary degree. Upon compaction by the first angled wall 120, the granular material is compacted by the central base portion 119. The central base portion 119 directs an amount of the force greater than the amount of force exerted by the second angled wall 121 or the first angled wall 120 into the granular material, compacting the granular material to a finished degree. Accordingly, the angled walls facilitate compaction of the road shoulder and reduce the amount of force required to draw the compacting attachment 18 over the road shoulder. The force exerted by the compacting attachment 18, in addition to vibration provided by the tamp vibrator 108, compacts the road shoulder in need of compacting.

After the compacting attachment 18 has traversed the portion of the road needing compaction, the user may stop the vehicle 20, disengage the tamp vibrator 108, and raise the apparatus 10 from the road shoulder. The user may then move the vehicle 20 to another portion of the road having a road shoulder requiring compaction. Alternately, the user may direct the hydraulic control valve 78 or the remote controller 81 to retract the tamp pivot actuator 104 and the rotational actuator 106 until the plate 102 is substantially parallel to the road and the attachment carriage 14. The user may then retract the actuators 40, 62 to return the apparatus 10 to the travel position.

The apparatus 10 including the compacting attachment 16, 18 may be concurrently operated with a sweeper. The sweeper is typically releasably connected to a front portion of the vehicle 20. The sweeper includes a brush rotations coupled to the sweeper. The brush may be raised or lowered and is pivotally coupled to the sweeper. Alternately, a sweeping machine operated in tandem with the vehicle 20 may be used to perform the function of the sweeper. When the apparatus 10 and the sweeper are used together, the granular material used to form the shoulder is deposited on the road adjacent an edge of the road where the road shoulder is to be formed. The granular material is typically deposited on the road and not adjacent the road to maximize safety. The vehicle 20 including the sweeper and the apparatus 10 follows the truck or is operated at a later time to form the road shoulder. The user lowers the sweeper to contact the road and positions the sweeper obliquely to the edge of the road. The brush rotates during use to sweep the granular material from the road to form an uncompacted shoulder. As the vehicle operates, the uncompacted shoulder is compacted by the apparatus 10, forming the road shoulder.

EXAMPLE

The following examples are merely illustrative and do not in any way limit the scope of the disclosure as described and claimed.

A test section of soft shoulder was prepared using a small berm material (#617/#411). The small berm material was distributed in a thickness of six inches and a width of two feet along a road edge for 120 feet to form the test section. A maximum density of the small berm material was determined to be 142.6 pounds per cubic foot and the optimal percent moisture was determined to be 7.8 percent after performing a Modified Proctor Test in accordance with ASTM D 1557-91

Procedure C. The test section was divided into three equal portions of 40 feet to form Section 1, Section 2, and Section 3. Each of the portions was compacted in a different manner.

A Troxler 3440 moisture density gauge was used to measure the percent density, the pounds per cubic foot, and the percent moisture of each of Section 1, Section 2, and Section 3. Three readings were performed in each section. The Troxler 3440 moisture density gauge was set to "Backscatter Mode and a standard count was conducted prior to the experiment. The results of the standard count are shown in Table 1 below.

TABLE 1

| Reading | % P |
|---|---|
| MS 622 | −0.3 |
| DS 2074 | −0.4 |

Section 1 was compacted using the apparatus 10 including the compacting attachment 18. The results of the compaction of Section 1 are shown in Table 2 below.

TABLE 2

| Percent Density | Pounds per Cubic Foot | Percent Moisture |
|---|---|---|
| 83.5 | 128.4 | 7.8 |
| 82.5 | 127.2 | 8.0 |
| 81.3 | 122.4 | 5.7 |

Section 2 was compacted using an Ingersoll-Rand PT-140 pneumatic roller. The results of the compaction of Section 2 are shown in Table 3 below.

TABLE 3

| Percent Density | Pounds per Cubic Foot | Percent Moisture |
|---|---|---|
| 72.9 | 112.7 | 8.5 |
| 79.8 | 123.6 | 8.6 |
| 77.7 | 120.6 | 7.8 |

Section 3 was compacted using the apparatus 10 including the compacting attachment 16. The results of the compaction of Section 3 are shown in Table 4 below.

TABLE 4

| Percent Density | Pounds per Cubic Foot | Percent Moisture |
|---|---|---|
| 80.0 | 123.9 | 8.3 |
| 78.5 | 121.1 | 7.9 |
| 78.6 | 120.8 | 7.8 |

As illustrated in TABLES 2-4, the average percent density of readings performed in both Section 1 and Section 3 was greater than the average percent density of readings performed in Section 2. It was also shown that the average pounds per cubic foot of readings performed in both Section 1 and Section 3 was greater than the average percent density of readings performed in Section 2. Further the average percent moisture of readings in both Section 1 and Section 3 was greater than the average percent moisture of readings performed in Section 2. Thus, the average pounds per cubic foot of readings and the percent moisture of readings performed in both Section 1 and Section 3 were closer to the maximum density and the optimal percent moisture of the small berm material than the average pounds per cubic foot of readings and the percent moisture of readings performed in Section 2.

The apparatus for compacting road shoulders 10 including the compacting attachment 16, 18 is advantageous because the apparatus 10 does not extend substantially beyond the profile of the vehicle 20 when the apparatus 10 is in the travel position. The apparatus 10 may be safely transported from one worksite to another without risk of collision of the apparatus 10 with objects located outside the profile of the vehicle.

The apparatus 10 including the compacting attachment 16, 18 may be adjusted according to the grade of the road shoulder, permitting the road shoulder having a steep grade to be compacted without risk of a roll-over or other accident, thereby maximizing safety. Further, the apparatus 10 in accord with the present disclosure militates against the formation of ruts in the road shoulder during compaction.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. An apparatus for compacting road shoulders comprising:

a primary carriage adapted to be mounted to a vehicle, the primary carriage including a pair of spaced apart transverse supports with a first actuator disposed therebetween;

an attachment carriage slidably mounted to the primary carriage, a first end of the first actuator coupled to the primary carriage and a second end of the first actuator coupled to the attachment carriage; and a compacting attachment adjustably mounted to the attachment carriage, wherein the attachment carriage is selectively movable between an operating position and a travel position, the attachment carriage and the compacting attachment positioned substantially within a side-to-side profile of the vehicle in the travel position.

2. The apparatus of claim 1, wherein the compacting attachment is a roller.

3. The apparatus of claim 1, wherein a vibrator is disposed on one of the primary carriage, the attachment carriage, and the compacting attachment.

4. The apparatus of claim 3, wherein the first actuator urges the attachment carriage along a guide coupled to the primary carriage, wherein the actuator and the vibrator are in communication with a control system.

5. The apparatus of claim 4, wherein the first actuator urges the attachment carriage to extend laterally from the vehicle.

6. The apparatus of claim 1, wherein the compacting attachment is a tamp.

7. The apparatus of claim 6, wherein the tamp is pivotally coupled to the attachment carnage.

8. The apparatus of claim 6, wherein the tamp includes a central base portion having at least one angled wall extending therefrom.

9. The apparatus of claim 8, wherein the tamp includes a leading edge and a compaction vertex formed by the at least one angled wall.

10. The apparatus of claim 1, wherein the attachment carriage includes a support frame and an attachment member, the attachment member adjustably mounted to the support frame.

11. The apparatus of claim 10, further comprising a second actuator coupled to the support frame and the attachment member, the second actuator urging the attachment member along a guide coupled to the support frame.

12. The apparatus of claim 10, wherein at least a portion of the compacting attachment is pivotably coupled to the attachment member.

13. The apparatus of claim 10, further including a third actuator coupled to the attachment member and the compacting attachment, the third actuator pivotably urging the compacting attachment in respect of the attachment member.

14. The apparatus of claim 10, wherein the first actuator urges the attachment member to extend laterally from the vehicle.

15. The apparatus of claim 10, wherein the attachment member includes at least one attachment point, the attachment point one of vertically oriented and horizontally oriented.

16. An apparatus for compacting road shoulders comprising:

a primary carriage adapted to be mounted to a vehicle, the primary carriage including a pair of spaced apart transverse supports with a first actuator disposed therebetween;

an attachment carriage slidably mounted to the primary carriage, a first end of the first actuator coupled to the primary carriage and a second end of the first actuator coupled to the attachment carriage;

a compacting attachment adjustably mounted to the attachment carriage; and a vibrator disposed on the compacting attachment;

wherein the attachment carriage is selectively movable between an operating position and a travel position, the attachment carriage and the compacting attachment positioned substantially within a side-to-side profile of the vehicle in the travel position.

17. The apparatus of claim 16, wherein the compacting attachment is a roller.

18. The apparatus of claim 16, wherein the compacting attachment is a tamp.

19. The apparatus of claim 16, further comprising an actuator coupled to the primary carriage and the attachment carriage, the actuator urging the attachment carriage along a guide coupled to the primary carriage.

20. An apparatus for compacting road shoulders comprising:

a primary carriage adapted to be mounted to a vehicle;

an attachment carriage including a support frame and an attachment member, the attachment member adjustably mounted to the support frame, the attachment carriage slidably mounted to the primary carriage;

a compacting attachment adjustably mounted to the attachment member;

a first actuator coupled to the primary carriage and the attachment carriage to urge the attachment carriage along a first guide coupled to the primary carriage, the primary carriage including a pair of spaced apart transverse supports with the first actuator disposed therebetween, a first end of the first actuator coupled to the primary carriage and a second end of the first actuator coupled to the attachment carriage;

a second actuator coupled to the support frame and the attachment member to urge the attachment member along a second guide coupled to the support frame;

a vibrator disposed on the compacting attachment; and a control system in communication with the first actuator, the second actuator, and the vibrator.

* * * * *